United States Patent [19]

Wakasa et al.

[11] Patent Number: 4,712,985

[45] Date of Patent: Dec. 15, 1987

[54] DIESEL ENGINE FUEL INJECTION PUMP CAPABLE OF INJECTION TIMING ADJUSTMENT

[75] Inventors: Satoshi Wakasa; Toru Okazaki, both of Oyama, Japan

[73] Assignee: Kabushiki Kaisha Komatsu Seisakusho, Tokyo, Japan

[21] Appl. No.: 879,734

[22] Filed: Jun. 27, 1986

[30] Foreign Application Priority Data

Jul. 24, 1985 [JP] Japan ..... 60-112448[U]

[51] Int. Cl.[4] ..... F04B 7/04; F04B 39/10; F02M 59/20

[52] U.S. Cl. ..... 417/486; 417/494; 417/499

[58] Field of Search ..... 417/486, 490, 494, 499; 123/500, 501, 503

[56] References Cited

U.S. PATENT DOCUMENTS

| | | | |
|---|---|---|---|
| 2,424,943 | 7/1947 | Nicolls | 417/387 |
| 3,492,947 | 2/1970 | Paine | 417/490 |
| 3,782,864 | 1/1974 | Perr | 417/493 |
| 3,847,510 | 11/1974 | Fenne | 417/499 |

FOREIGN PATENT DOCUMENTS

| | | | |
|---|---|---|---|
| 1502 | 1/1977 | Japan | 417/490 |
| 370534 | 4/1932 | United Kingdom | 417/490 |

*Primary Examiner*—Carlton R. Croyle
*Assistant Examiner*—Jane E. Obee
*Attorney, Agent, or Firm*—Armstrong, Nikaido, Marmelstein & Kubovcik

[57] ABSTRACT

A plunger assembly within a barrel is transversely split into two segments, with a timing fluid chamber therebetween for controllably varying the distance between the plunger segments in response to pressure applied thereto by a timing fluid introduced under variable pressure through a timing fluid inlet port. As the total length of the plunger assmebly is thus varied controllably, so is its prestroke which is the distance traversed by the plunger assembly on its compression stroke from one extreme position thereof to an intermediate position where the plunger assembly completely covers the fuel inlet port. Not only is the injection timing thus controlled by the injection pump itself, but also a high injection pressure is realized at low engine speed or under light load.

3 Claims, 5 Drawing Figures

DIESEL ENGINE FUEL INJECTION PUMP CAPABLE OF INJECTION TIMING ADJUSTMENT

BACKGROUND OF THE INVENTION

This invention relates to fuel injection pumps for diesel engines, and in particular to improvements in a Bosch fuel injection pump.

In a diesel fuel injection system, as is well known, the fuel is injected under pressure into the combustion chamber toward the end of the compression stroke. The heat produced by compressing the air ignites the injected fuel, eliminating the need for spark plugs or a separate ignition system. The Bosch fuel injection pump has found extensive use in such injection systems for metering the fuel and delivering it under pressure to the nozzle or nozzles at the diesel engine cylinder or cylinders. It includes a cam driven plunger reciprocably mounted within a barrel to define a pumping chamber. A fuel inlet port or ports are open to this pumping chamber in such a position that, on its power stroke, the plunger travels some distance before it covers the fuel inlet port or ports, and then starts pressurizing the fuel that has been confined in the pumping chamber. This distance between the extreme plunger position at the start of the power stroke and the intermediate position where the plunger covers the fuel inlet port or ports is referred to as the prestroke of the plunger. The prestroke has so far been fixed.

This type of fuel injection pump has had some weaknesses. At low engine speed the plunger is driven at correspondingly low speed, so that the fuel has been delivered to the combustion chamber under low pressure. The fuel pressure has also been low when the engine is under light load, demanding a small amount of oil, because then, such being the contour of the drive cam, the plunger is traveling at low speed when it completes the fuel injection. Combustion efficiency has thus been relatively low under these conditions.

The prior art construction of the fuel injection pump has required a sepatate injection timing mechanism of very complex design. The complex timing mechanism has added substantially to the manufacturing cost of the diesel fuel injection system.

SUMMARY OF THE INVENTION

The present invention has succeeded in eliminating the noted weaknesses of the fuel injection pump by making it possible to controllably vary the prestroke of the plunger.

According to the invention, stated in brief, a diel engine fuel injection pump is provided which comprises a plunger assembly reciprocably mounted within housing means and defining a pumping chamber therein. Drive means drives the plunger assembly between a first extreme position, where a fuel inlet port in the housing means is uncovered by the plunger assembly for the admission of fuel into the pumping chamber, and a second extreme position. Traveling on its power stroke from the first toward the second extreme position, the plunger assembly starts the pressurization of the fuel upon completion of the prestroke from the first extreme position to an intermediate position where the plunger assembly covers the fuel inlet port. The plunger assembly is transversely split into at least two segments movable toward and away from each other within limits. Variable timing fluid pressure may be introduced between the segments of the plunger assembly for controllably varying the distance therebetween and, in consequence, the prestroke of the plunger assembly.

The changes in the prestroke of the fuel injection pump that have been realized by this invention make it possible to increase the injection pressure at low engine speed or when the amount of fuel injected per cycle is small. Engine performance under these conditions can thus be remarkably improved. The fuel injection pump of this invention requires no external timing mechanism; nevertheless, the pump itself is simple and inexpensive in construction.

The above and other features and advantages of this invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

Figure 1:
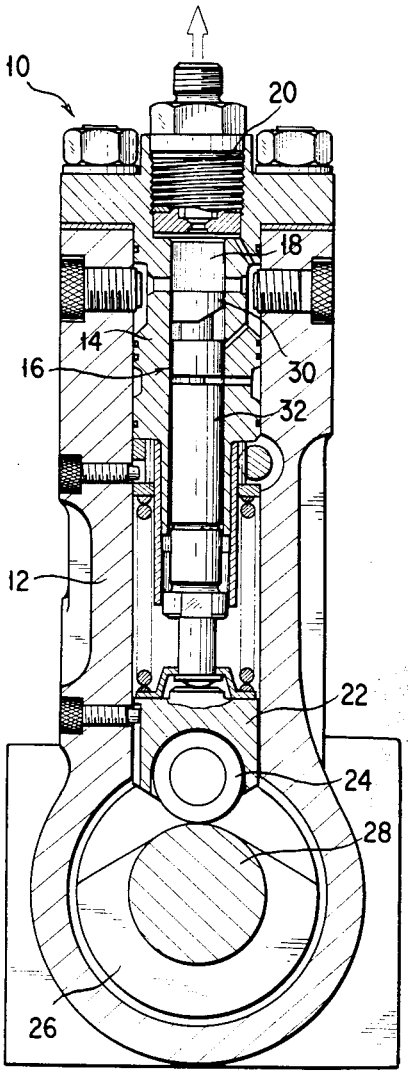
FIG. 1 is an axial section through the fuel injection pump constructed in accordance with the novel concepts of this invention.

A preferred form of the fuel injection pump in accordance with the invention is shown in its entirety in FIG. 1 and therein generally designated 10. The fuel injection pump 10 has a pump body or housing 12 having fixedly mounted therein an upstanding barrel 14. The pump body 12 and barrel 14 constitute in combination the housing means of the pump 10. Reciprocably mounted within the barrel 14 is a plunger assembly 16 definining in combination with the barrel a pumping chamber 18 on the top of the plunger assembly. The pumping chamber 18 communicates with a fuel nozzle or nozzles, not shown, via a delivery valve 20. The bottom end of the plunger assembly 16 rides via a tappet 22 and roller 24 on a drive cam 26 on a camshaft 28. Thus, with the rotation of the drive cam 26 with the camshaft 28, the plunger assembly 16 moves up and down within the barrel 14.

Figure 2:
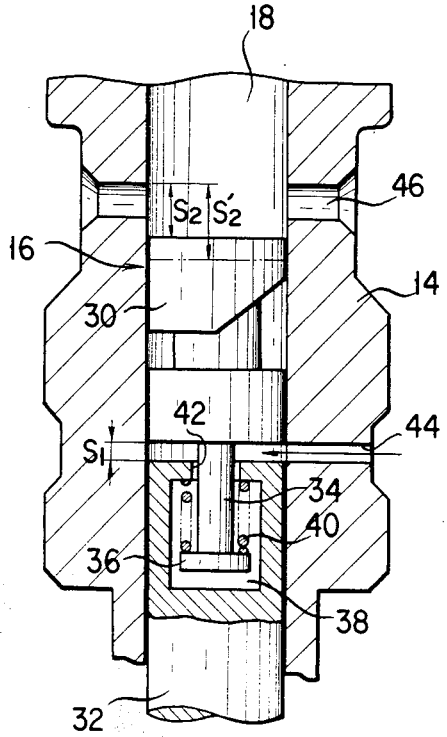
FIG. 2 is an enlarged, fragmentary axial section through the fuel injection pump, showing in particular the plunger assembly and barrel.

As illustrated on an enlarged scale in FIG. 2, the plunger assembly 16 is transversely split into two segments 30 and 32 in accordance with the principles of this invention, although the plunger assembly could be so split into three or more segments within the scope of the invention. The upper plunger segment 30 is open to the pumping chamber 18, whereas the lower plunger segment 32 is engaged as aforesaid with the cam 26 via the tappet 22 and roller 24. The two plunger segments 30 and 32 are coupled to each other, as described hereafter, so as to be movable toward and away from each other within limits for controllably varying the prestroke of this fuel injection pump 10.

The upper plunger segment 30 has a stem 34 extending downwardly therefrom and terminating in a flange-like spring seat 36. The stem 34 with the spring seat 36 is loosely received in a timing fluid chamber 38 defined in the lower plunger segment 32. Sleeved upon the stem 34, a helical compression spring 40 is engaged between the spring seat 36 and the opposed wall of the lower plunger segment 32, acting to bias the two plunger segments 30 and 32 toward each other. The timing fluid chamber 38 has an opening 42 through which the stem 34 extends with clearance. Through this clearance the timing fluid chamber 38 communicates, at least when the plunger assembly 16 is in the lowermost position depicted in FIGS. 1 and 2, with a timing fluid pressure inlet port 44 in the barrel 14. Variable timing fluid pressure is to be introduced into the timing fluid chamber 38 for adjustably moving the upper plunger segments 30 away from the lower plunger segment 32 against the force of the compression spring 40.

FIG. 2 also indicates that the barrel 14 has further defined therein one or more fuel inlet ports 46 disposed in a predetermined position in the axial direction of the barrel. The fuel inlet port 46 is to be placed in and out of communication with the pumping chamber 18 by the plunger assembly 16.

In operation, when the plunger assembly 16 is held in its lowermost position by the drive cam 26 as in FIGS. 1 and 2, a timing fluid pressure may be introduced as required into the timing fluid chamber 38 via the inlet port 44. The timing fluid pressure will cause the upper plunger segment 30 to move away from the lower plunger segment 32 to an extent determined by the counterbalancing of the force of the compression spring 40 against the timing fluid pressure. Thus displaced upwardly, the upper plunger segment 30 leaves the fuel inlet port 46 uncovered for the admission of the fuel into the pumping chamber 18.

The lower plunger segment 32 starts ascending with the rotation of the drive cam 26, completely closing the timing fluid inlet port 44 when it travels a distance S1. The consequent confinement of the timing fluid pressure in the chamber 38 makes it possible for the two plunger segments 30 and 32 to travel on the rest of the power stroke with their relative axial positions unchanged.

Thus traveling with the lower plunger segment 32, the upper plunger segment 30 completely closes the fuel inlet ports 46 at the end of the prestroke S2. The subsequent ascent of the plunger assembly 16 results in the pressurization of the fuel that has been trapped in the pumping chamber 18. The pressurized fuel is sent out by the delivery valve 20 toward the diesel engine cylinder or cylinders. The power stroke of the plunger assembly 16 is completed as it reaches the uppermost position, from which the plunger assembly descends for the repetition of the same cycle of operation.

The dashed line in FIG. 2 represents the position of the top of the upper plunger segment 30 when the plunger assembly 16 is in the lowermost position and when no timing fluid pressure is introduced into the chamber 38. It will be seen, then, that the full prestroke of this fuel injection pump 10 is as indicated at S2'. This full prestroke S2' may be adjustably reduced, as to S2 for instance, by supplying the timing fluid pressure ranging from zero up to, say, 10 kg/cm$^2$. The pump 10 requires no separate timing mechanism except for the means for supplying the timing fluid pressure.

Figure 3A:
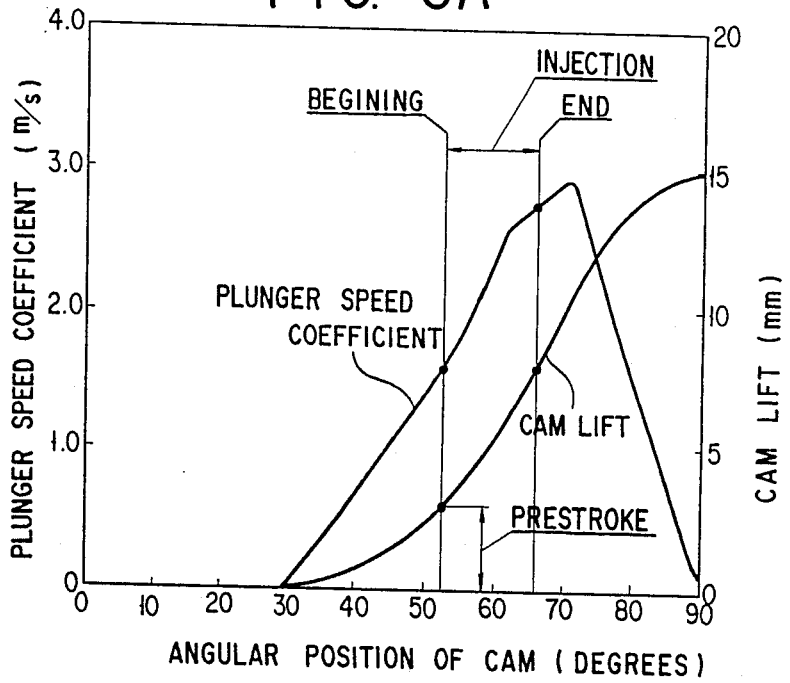
FIGS. 3A and 3B are graphs showing the periods of injection in relation to plunger speed and cam lift (plunger position) when the prestroke of the fuel injection pump in accordance with the invention is set at two different values.
Figure 3B:
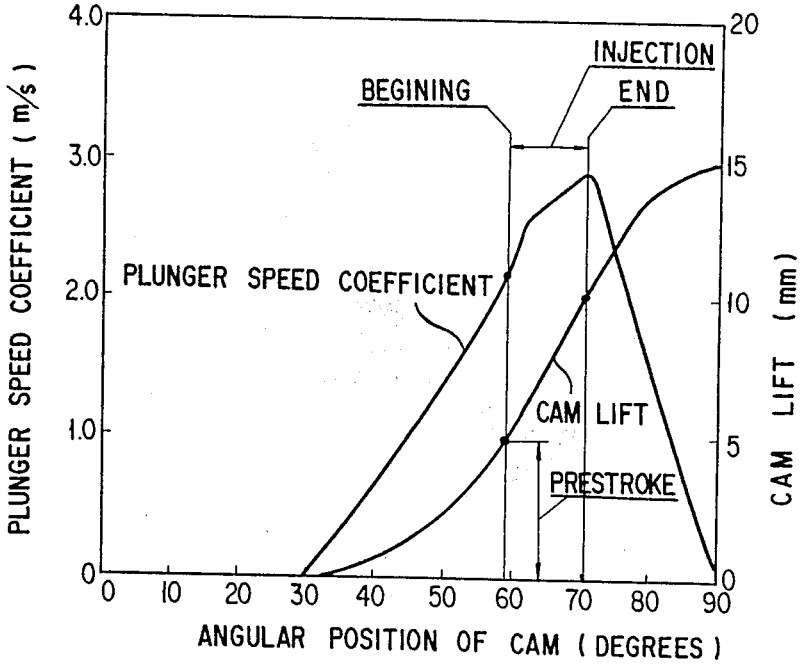

The fact that the injection timing is adjustable by varying the timing fluid pressure will be apparent from a consideration of FIGS. 3A and 3B. The prestroke S2 of an experimental model of the fuel injection pump 10 was set at 3 and 5 mm (timing fluid pressure at 10 and 0 kg/cm$^2$ respectively) in order to ascertain the resulting changes in injection timing. FIGS. 3A and 3B graphically represents the injection timing in relation to the speed coefficient of the plunger in m/s, the angular position of the drive cam in degrees, and the cam lift in mm, when the prestroke S2 was set at 3 and 5 mm respectively.

Figure 4:
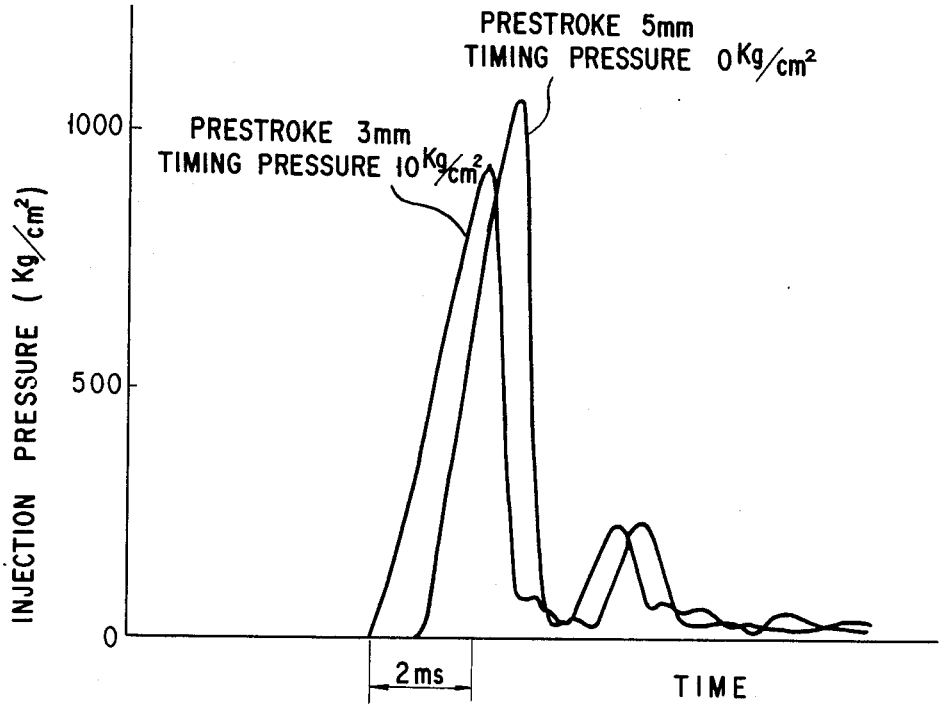
FIG. 4 is a graph showing the curves of the injection pressure of the fuel injection pump in accordance with the invention against time when its prestroke is set at the two different values.

The injection pressure also changes in step with the prestroke of the fuel injection pump 10. FIG. 4 graphically demonstrates the curves of injection pressure against time when the prestroke was set at 3 and 5 mm. The pump speed tested was 1000 rpm, and the amount of fuel injected was 420 mm$^3$ per stroke.

It is to be understood that the present invention is not to be limited by the exact details of the foregoing embodiment but includes a variety of modifications or changes within the broad teaching hereof.

What is claimed is:

1. A diesel engine fuel injection pump capable of injection timing adjustment, comprising:

(a) housing means;

(b) a plunger assembly reciprocably mounted within the housing means and defining a pumping chamber therein;

(c) the housing means having defined therein a fuel inlet port to the pumping chamber in a predetermined position in the longitudinal direction of the pumping chamber;

(d) drive means for reciprocably moving the plunger assembly within the pumping chamber between a first extreme position, where the fuel inlet port is uncovered by the plunger assembly for the admission of fuel into the pumping chamber, and a second extreme position, the plunger assembly starting the pressurization of the fuel upon completion of a prestroke extending from the first extreme position to an intermediate position where the plunger assembly covers the fuel inlet port;

(e) the plunger assembly being formed of at least two transversely split segments movable toward and away from each other within limits and including resilient means biasing the segments of the plunger assembly toward each other; and (f) the housing means further including a timing fluid inlet port for introduction of a timing fluid under variable pressure between the segments of the plunger assembly to move the plunger assembly segments away from each other to an extent that timing fluid pressure is counterbalanced by force of said resilient means for controllably varying the distance therebetween and, in consequence, for varying the prestroke of the plunger assembly solely in response to variation of said timing fluid pressure to effect adjustment of injection timing.

2. The diesel engine fuel injection pump as recited in claim 1, wherein one of the segments of the plunger assembly has a stem extending therefrom and loosely received in a timing fluid chamber defined in the other segment, the timing fluid chamber communicating, at least when the plunger assembly is in the first extreme position, with said timing fluid inlet port in the housing means for the introduction of the timing fluid under pressure.

3. The diesel engine fuel injection pump as recited in claim 2, wherein the stem has a spring seat formed thereon, and wherein the resilient means is accommodated in the timing fluid chamber and is engaged between the spring seat on the stem and said other segment of the plunger assembly.

* * * * *